United States Patent [19]

Hiromori et al.

[11] Patent Number: 4,523,753

[45] Date of Patent: Jun. 18, 1985

[54] APPARATUS FOR FEEDING FLAT ARTICLES

[75] Inventors: Kunio Hiromori; Kiyoshi Tsuda, both of Tokyo, Japan

[73] Assignee: Nippon Electric Co., Ltd., Tokyo, Japan

[21] Appl. No.: 433,980

[22] Filed: Oct. 13, 1982

[30] Foreign Application Priority Data

Oct. 14, 1981 [JP] Japan ..... 56-152745[U]

[51] Int. Cl.[3] ..... B65H 3/08

[52] U.S. Cl. ..... 271/31.1; 271/34; 271/149

[58] Field of Search ..... 271/8 A, 30 A, 94, 34, 271/126, 129, 149, 150, 148

[56] References Cited

U.S. PATENT DOCUMENTS 2,572,509 10/1951 Novick ..... 271/150
2,584,730 2/1952 Novick ..... 271/150
2,952,457 9/1960 Fliegner ..... 271/34 X
3,260,520 7/1966 Sugden ..... 271/34 X
3,709,481 1/1973 Meyer ..... 271/30 A

*Primary Examiner*—Richard A. Schacher
*Attorney, Agent, or Firm*—Laff, Whitesel, Conte & Saret

[57] ABSTRACT

The invention can accurately feed flat articles one-by-one. The packing density of flat articles in a hopper section is correctly detected even if they have various and indefinite shapes and conditions, such as mail, envelopes, cards and other flat articles. These articles are transferred from the hopper section to a feed mechanism section, in response to the detected packing density. The flat articles are transferred to the feed mechanism section in accordance with the distance between the centers of the flat articles while they are in the hopper section, the distance inversely corresponding to the packing density of the flat articles. Light reflection is preferably used in order to detect the distance between the centers of the flat articles.

3 Claims, 6 Drawing Figures

APPARATUS FOR FEEDING FLAT ARTICLES

BACKGROUND OF THE INVENTION

This invention relates to an apparatus for automatically processing flat articles and more particularly, to an apparatus for feeding flat articles such as letters, postcards, and paper sheets.

In a feeding apparatus, a large number of flat articles are stored inside a hopper section while being kept upright and are transferred to a feed mechanism section, where the flat articles are sequentially fed out one by one to a next processing apparatus. Such an apparatus is disclosed in German Pat. No. 1,217,405.

As the flat articles are sequentially fed out one by one, the packing density of the flat articles inside the hopper section changes to be more sparse. This change is detected and the remaining flat articles in the hopper section are transferred to the feed mechanism section in accordance with this change in order to keep the packing density either constant or within a predetermined range. The packing density of the flat articles has been conventionally detected by means such as a micro-switch with a push force detection lever that detects the pressure of the flat articles being transferred to the feed mechanism section. This pressure is regarded as the packing density of the flat articles and is converted into an electric signal to perform an ON/OFF control of the transfer of the flat articles to the feed mechanism section in accordance with the electric signal.

Especially when the flat articles to be processed are mail items such as post cards and letter envelopes, they are remarkably different from each other in the paper quality, hardness and softness, thickness, weight, and so forth. These differences are all the more enhanced by the contents of envelopes. Accordingly, the conventional practical apparatus must adopt the pushing force delivered from flat articles having an average hardness as the reference in order to judge the packing density of the flat articles.

In case there is a high ratio of hard flat articles to normal or soft articles in the hopper section, the push force detection lever connected to the micro-switch is inertialy urged. This means that gaps are formed between the flat articles at the front part of the feed mechanism section and the number of the flat articles in the hopper section is reduced. Then, push force detection lever can not easily return to its original position so that the flat articles can not be transferred to the feed mechanism section. This results in a reduction of feed accuracy and in feed interruption, causing eventually a reduction of the processing speed. The interrupted feed also increases noise. To the contrary, if the ratio of softer or lighter flat articles such as air-entrapping envelops is great, the push force detection lever can not be pushed even if the packing density of the flat articles is high. As a consequence, the flat articles are excessively transferred to the feed mechanism section and the force of friction between the flat articles increases so that they can not be correctly fed one by one, but they are incorrectly fed as two or more flat articles simultaneously.

To prevent a simultaneous feeding of two or more flat articles, the conventional apparatus of the kind described above is equipped with a vacuum suction sub-chamber positioned beside the feed mechanism section to cause the next flat article to cling owing to the suction. However, the degree of air-permeation varies depending upon the kind and quality of the flat articles. Hence, the push force detected on the side of the feed mechanism section does not always represent the correct packing density between the flat articles. In other words, the flat articles having less air-permeation and, therefore, the suction is stronger owing to the negative pressure of the vacuum suction sub-chamber than the flat articles having high air-permeation. The push force of the flat articles becomes great even if large gaps exist between the remaining flat articles.

Hence, in the prior art, the micro-switch with the push force detection lever can not detect the pressure corresponding to the actual packing density of the flat articles and the feed of the flat articles can not be effected correctly.

SUMMARY OF THE INVENTION

It is, therefore, an object of the present invention to provide an apparatus for feeding flat articles, which can accurately feed flat articles one by one, and in which the packing density of flat articles in a hopper section is correctly detected even if they have various and indefinite conditions such as mail items. The flat articles in the hopper section are transferred to a feed mechanism section in response to the detected packing density.

The feature of the apparatus according to the present invention is in that the flat articles are transferred to the feed mechanism section in accordance with the distance between the centers of the flat articles in the hopper section. This distance inversely corresponds to the packing density of the flat articles. Thus, the prior art pressure detection lever is not employed as in the conventional apparatus. Light reflection is preferably used in order to detect the distance between the centers of the flat articles. In particular, it is preferable to use a reflecting type photo-sensor including a pair of a light-emitting element. A light-receiving element is disposed below the flat articles that are being transferred while kept upright. The reflected light incident to the light-receiving element in the photosensor from the flat articles is inversely proportional to the distance between the centers of the flat articles, so that the flat articles can be correctly fed one by one by controlling the transfer of the flat articles to the feed mechanism section in accordance with the output from the light-receiving element. The transfer of the flat articles to the feed mechanism section can be controlled more correctly if a plurality of reflecting type photo-sensors are disposed at different distances from the feed point to detect the distance between the centers of the flat articles at a plurality of positions.

BRIEF DESCRIPTION OF THE DRAWINGS

FIG. 2(*b*) is a sectional view taken in the direction Z in FIG. 1 and shows a case in which a gap occurs between flat articles;

FIG. 2(*c*) is also a sectional view taken in the direction Z in FIG. 1 and shows a case in which the gap between the flat articles becomes small;

DESCRIPTION OF THE PREFERRED EMBODIMENTS

Figure 1:
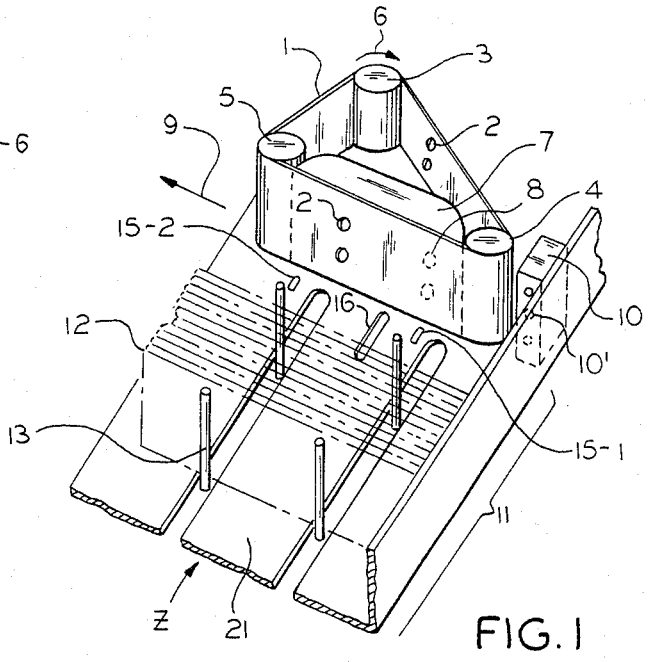
FIG. 1 is a perspective view showing an embodiment according to the present invention.

Referring to FIG. 1, an embodiment of the present invention is equipped with an endless suction belt 1 having suction holes 2 for picking up and conveying a flat article. The suction holes 2 are formed in a predetermined pitch around the endless suction belt 1. The endless suction belt 1 is wound around rollers 3, 4, and 5. The roller 3 is driven for rotation in the direction of arrow 6 by a driving mechanism (not shown). A main vacuum suction chamber 7, having vacuum suction holes 8, is disposed inside the suction belt 1 to face the back side of the suction belt 1, behind the suction position. Chamber 7 is connected with a vacuum pump (not shown). When the vacuum suction holes 8 are aligned with the suction holes 2, one flat articles is sucked against belt 1 at the suction pickup position and then is carried by the belt in the direction indicated by an arrow 9. An auxiliary vacuum suction chamber 10 is disposed at a location which is in parallel with the suction pickup position of the suction belt 1 and which is also connected with a vacuum pump (not shown). This auxiliary vacuum suction chamber 10 has suction holes 10′ for picking up a next flat article on its surface and for preventing the next flat article from being fed along with the previous flat article responsive to friction or the like when the previous flat article is picked up and fed by the endless suction belt 1. The endless suction belt 1, the main vacuum suction chamber 7 and the auxiliary suction chamber 10 together form a feed mechanism.

A hopper section 11 is disposed in succession to the feed mechanism. The flat articles 12 that have been aligned on their two sides are charged upright into the hopper section 11. A fork transfer mechanism 13 is disposed to transfer the flat articles 12 thus charged to the feed mechanism. The fork transfer mechanism 13 moves forth in two grooves defined on the bottom plate 21 of the hopper section 11 and conveys the flat articles 12 to the feed mechanism, in response to electric signals which are representative of the packing density of the flat articles, i.e., the distance between the centers of the flat articles. The fork 13 is moved by means of a driving mechanism (not shown). After reaching the end of the grooves, the fork transfer mechanism is pushed down below the bottom plate 21 and returned to the original position.

Figure 2A:
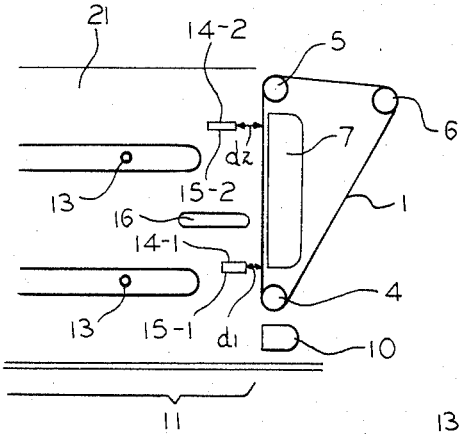
FIG. 2(*a*) is a plan view of the embodiment shown in FIG. 1.
Figure 2B:
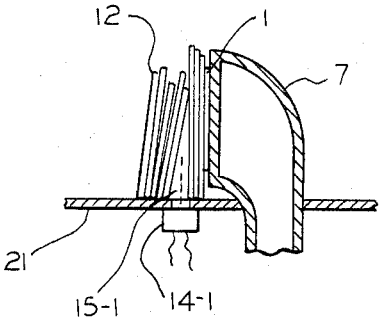
Figure 2C:
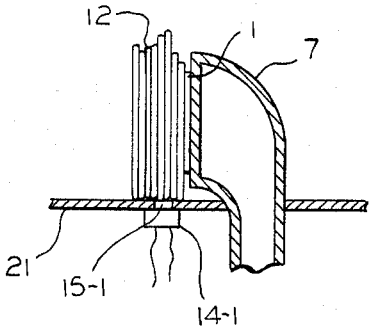

Referring also to FIG. 2(*a*), a jet hole 16 is formed for jetting a compressed air from the bottom plate 21 of the hopper section 11 in the proximity of the suction pickup position of the suction belt 1. When the compressed air is jetted from the jet hole 16, the flat articles are separated in order to prevent two flat articles from being fed from the feed mechanism simultaneously. Two holes 15-1 and 15-2 provide for mounting two sensors on the bottom plate 21 of the hopper section 11. In accordance with the present invention, each of the reflecting photo-sensors 14-1 and 14-2 consists of a pair formed by a light emitting element and a light receiving element, fitted into these holes 15-1 and 15-2, respectively. The light from the light emitting element in the photo-sensor is emitted to the bottom of the flat articles 12 stored upright in the hopper section 11 and its reflected light is received by the light receiving element. Accordingly, the quantity of light received by the light receiving element is proportional to the packing density of the flat articles inside the hopper section 11 and therefore, is inversely proportional to the distance between the centers of the flat articles. The greater the packing density, the greater the light received quantity.

In the present invention, the transfer of the flat articles to the fed mechanism is accurately controlled in accordance with the light quantity received by the light receiving element in the reflecting photo-sensor, that is, in accordance with the packing density of the flat articles. Accordingly, the flat articles can be fed from the feed mechanism one by one, without any interruption. In other words, when the packing density of the flat articles in the hopper section 11 increases, that is, the distance between the centers of the flat articles becomes narrow and the received light quantity becomes great, the transfer of the flat articles to the feed mechanism is stopped. When the distance between the centers of the flat articles increases and the received light quantity decreases, the flat articles are transfered to the feed mechanism.

In this embodiment, the two reflecting photo-sensors 14-1 and 14-2 are spaced apart from the suction pickup position of the suction belt 1 in different distances $d_1$ and $d_2$, respectively. For example, $d_1=15$ mm and $d_2=22$ mm. The transfer of the flat articles is stopped only when both photo-sensors 14-1 and 14-2 indicate that the distance between the centers of the flat articles is below a predetermined level. If the two sensors are placed at equidistant positions from the suction pickup position of the suction belt 1, a single flat article having a large width would sometimes cover both sensors and the transfer of the flat articles would be stopped even if a sufficient gap exists between it and other flat articles. The reflecting photo-sensors 14-1 and 14-2 are positioned with the different distances in order to prevent such an erroeneous operation.

The detecting operation by the reflecting photo-sensors will be clearly understood with reference to FIGS. 2(*b*) and 2(*c*). The reflecting photo-sensor 14-1 includes a pair comprising a light emitting element and light receiving element below the hole 15-1 formed in the bottom plate 21 of the hopper section 11 at a location which is close to the feed mechanism. The light emitting element in the photo-sensor emits light, as represented by a broken line in FIG. 2(*b*) while the light receiving element receives the light reflected from the flat articles 12.

In FIG. 2(*b*), the gaps occur between the flat articles in the proximity of the feed mechanism because the flat articles 12 are fed one by one by the feed mechanism. In this case, the light is not incident to the light receiving element in the reflecting photo-sensor 14-1 so that the fork transfer mechanism 13 is actuated. In consequence, the flat articles 12 are transferred to the feed mechanism and the distances between the centers of the articles are reduced so that the reflected light exceeds a predetermined level when it enters the light receiving element in the reflecting photo-sensor 14-1. Hence, the fork transfer mechanism 13 stops operating. In other words, the feeding state shown in FIG. 2(*c*) is reached. As the state shown in FIG. 2(*b*) and the state 2(*c*) are alternately established repeatedly, the flat articles 12 are sequentially transferred to the feed mechanism and fed therefrom.

In the present invention, the distances between the centers of the flat articles are detected by the reflected light picked up by the photo-sensors. Accordingly, unlike the prior art apparatus, the fork transfer mechanism does not exceedingly push the flat articles to the feed mechanism even if the envelopes contain air and if the paper quality of the envelopes or postcards is soft. For this reason, the flat articles can be accurately fed, one by one, from the feed mechanism.

Figure 3:
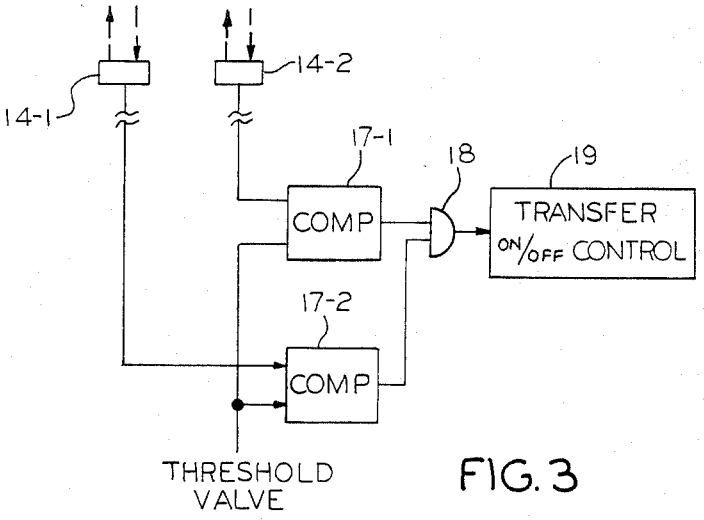
FIG. 3 is a block diagram of a circuit for controlling the transfer of the flat articles responsive to the output of a reflecting photo-sensors.

FIG. 3 is a block diagram of a circuit for carrying out the transfer control of the flat articles shown in FIG. 1. The output of each of the two reflecting photo-sensors 14-1 and 14-2 is compared with a threshold value by each of two comparators 17-1 and 17-2. The comparison output is applied through an AND gate 18 to a transfer ON/OFF control section 19. When the outputs of both sensors 14-1 and 14-2 are greater than the threshold values, the control section 19 stops the transfer of the flat articles. In the present invention, since the two sensors 14-1 and 14-2 are at different positions as measured from the suction pickup position of the suction belt 1 other, the probability that both sensors will detect the same flat articles simultaneously is extremely small. Hence, the distance between the centers of the flat articles which indicates the packing density can be reliably detected.

As can be clearly understood from the foregoing explanation of the operation, the distance between the centers of the flat articles is easily detected with a simple construction. Accordingly, even if the flat articles are mixtures of various kinds of articles such as envelopes and postal cards, the apparatus of the present invention does not cause an interruption of the transfer of the flat articles to the feed mechanism and, two or more flat articles are prevented from being fed simultaneously as a result of their mutual friction when they are excessively pushed. Furthermore, the apparatus of the present invention remarkably minimizes the interruption of the feed of the flat articles from the feed mechanism in comparison with the prior art apparatus and, therefore, reduces the noise by about 5 dB.

Figure 4:
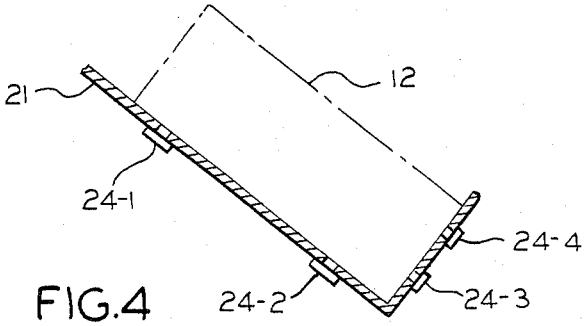
FIG. 4 is a sectional view showing a part of another embodiment of the present invention containing a plurality of reflecting photo-sensors.

Though the foregoing embodiment makes use of the reflecting type photo-sensor including a pair of the light-emitting and light-receiving elements, it would be obvious to those skilled in the art that the same function can be obtained by arranging an independent light emitter and an independent light receiver to detect the distance between the centers of the flat articles. Depending upon the kinds of the flat articles and the configuration of the hopper section, a plurality of reflecting type photo-sensors 24-1, 24-2, 24-3, 24-4 may be disposed at positions corresponding to the two sides of the flat article, as shown in FIG. 4, in order to prevent erroneous detection due to the inclination of the flat articles.

What is claimed is:

1. An apparatus for feeding flat articles comprising:

hopper means for storing flat articles in an upright position;

feeding means at the edge of said hopper means for picking up and feeding the flat articles stored in said hopper means, one by one;

a plurality of detection means, each for detecting the pack density of the flat articles stored in said hopper means, said plurality of detection means being located at different positions which are longitudinally distributed away from the pick up position of said feeding means, said different positions also being distributed in a longitudinal direction of the flat articles stored in said hopper means; and transfer means responsive to said plurality of detection means for transferring said flat articles stored in said hooper means to said feeding means.

2. The apparatus for feeding flat articles as claimed in claim 1, in which each of said detection means include:

light source means for emitting a light beam toward the edges of said flat articles stored in said hopper means;

photoelectric means for receiving the light beam reflected from said edges of said flat articles to produce electric signals; and comparing means for comparing said electric signals with a predetermined threshold level.

3. The apparatus for feeding flat articles as claimed in claim 1, whereby said transfer means stops to transfer said flat articles when said plurality of detection means simultaneously detect a pack density which is greater than a predetermined density.

* * * * *